United States Patent [19]

Newkirk

[11] Patent Number: 4,467,683

[45] Date of Patent: Aug. 28, 1984

[54] SHEAR MECHANISM FOR GLASS FEEDER

[75] Inventor: Mark C. Newkirk, Vineland, N.J.

[73] Assignee: Maul Technology Corporation, Millville, N.J.

[21] Appl. No.: 388,051

[22] Filed: Jun. 14, 1982

[51] Int. Cl.[3] ..... B26D 5/08

[52] U.S. Cl. ..... 83/54; 83/600; 83/623

[58] Field of Search ..... 83/600, 602, 623, 54

[56] References Cited

U.S. PATENT DOCUMENTS 2,680,937 6/1954 Peiler .

3,205,746 9/1965 Copeland ..... 83/600 X 3,736,826 6/1973 Ward ..... 83/600

4,230,010 10/1980 Guenthner ..... 83/600

*Primary Examiner*—Donald R. Schran

*Attorney, Agent, or Firm*—Seidel, Gonda & Goldhammer

[57] ABSTRACT

A shear mechanism adapted to be attached to a glass feeder for cutting a glass stream into gobs includes a housing supporting a pair of blade arms. At least one blade is connected to each arm. The blades are adapted to be in overlapping relationship in one position of the arms. A motor is supported by the housing and has its output mechanically connected to a pair of shafts for oscillating the arms in unison in opposite directions between open and closed positions.

10 Claims, 3 Drawing Figures

SHEAR MECHANISM FOR GLASS FEEDER

BACKGROUND

A shear mechanism having a pair of blades which cooperate to shear a continuous stream of glass into gobs is known. For example, see U.S. Pat. No. 2,680,937. The mechanism disclosed in said patent suffers from a number of disadvantages. Prior art devices which are comprised of cams, rods, levers, etc. provide poor performance due to vibrations, space limitations, etc. Such devices have limited flexibility since it is necessary to stop the machine and change the cams when altering the number of shear cuts per unit time. Each shear cam has a limited range of shear cuts per minute within which its operation is optimal. Above or below that range produces less than optimum shearing.

Such devices have a limited range of adjustment of the position of the shear mechanism with respect to the feeder bowl. Maintenance and adjustment of blades is difficult since the blades are beneath the feeder at all times and are in an area which is difficult to attain access to by an operator. Due to the construction of the prior art shear mechanism, it was not possible to adjust the phase relationship of the shears relative to the feeder mechanism or adjust the angular opening of the arms on the fly.

The present invention is directed to a solution of the above problems.

SUMMARY OF THE INVENTION

The shear mechanism of the present invention is adapted to be attached to a feeder bowl for cutting a glass stream into gobs. The mechanism includes a housing adapted to be attached to the feeder bowl. First and second shafts are provided in the housing. A discrete arm is connected to each shaft. At least one discrete blade is connected to each arm. The blades are in overlapping relation in one position of the arms. A reversible electric motor is supported by the housing. The motor has its output mechanically connected to said shafts for oscillating said shafts and arms in opposite directions between open and closed positions.

It is an object of the present invention to provide a shear mechanism which does not suffer from the disadvantages described above.

It is another object of the present invention to provide a shear mechanism which may be adjusted on the fly, wherein the speed of the blades may be varied as they move between open and closed positions, and wherein the blades may be indexed to a position where they are easily accessible to an operator.

Other objects and advantages of the present invention will be set forth hereinafter.

For the purpose of illustrating the invention, there is provided in the drawing a form which is presently preferred; it being understood, however, that this invention is not limited to the precise arrangements and instrumentalities shown.

DETAILED DESCRIPTION

Figure 1:
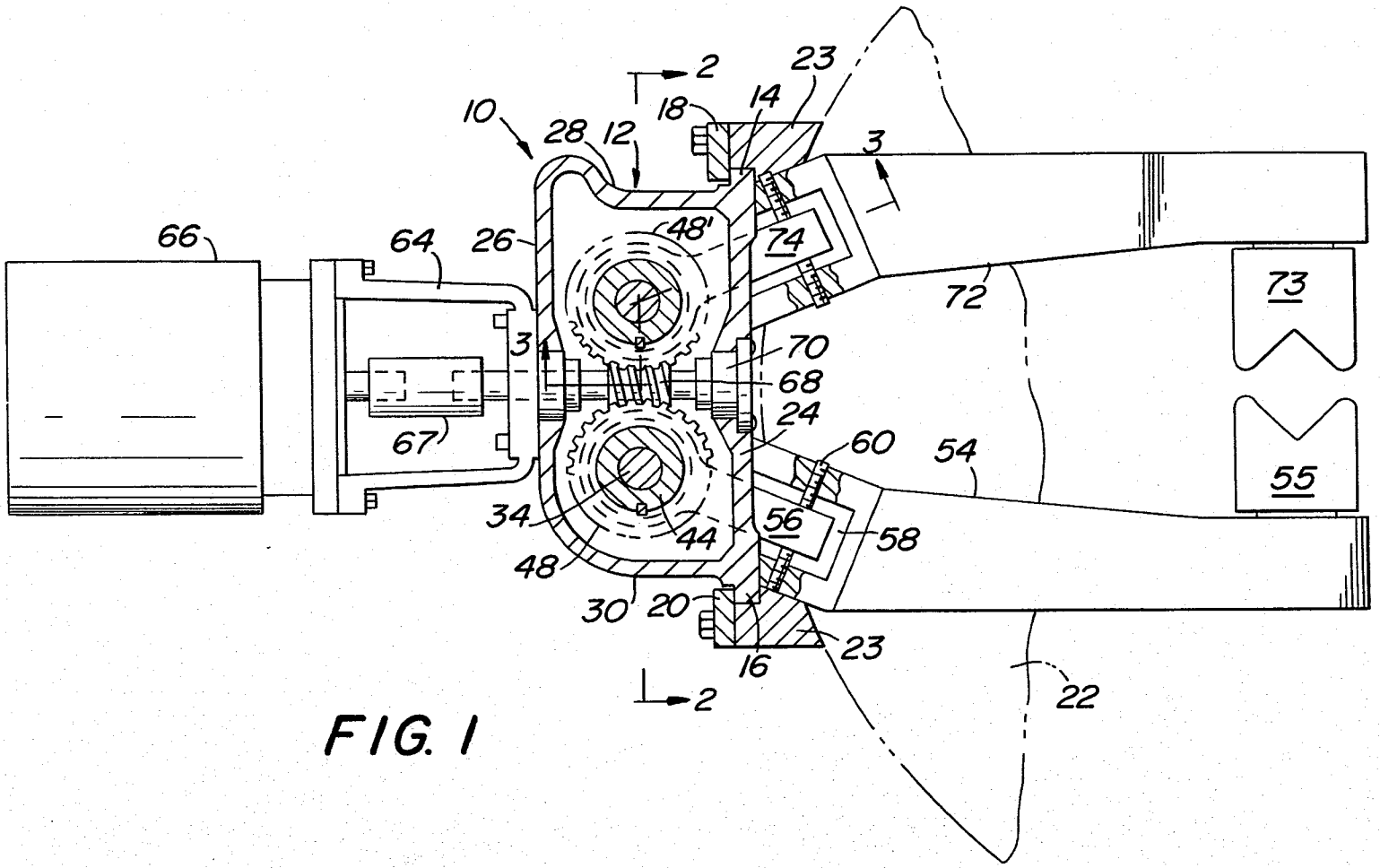
FIG. 1 is a horizontal sectional view through the shear mechanism at the elevation shown in FIG. 2.

Referring to the drawing in detail, wherein like numerals indicate like elements, there is shown in FIG. 1 a shear mechanism in accordance with the present invention designated generally as 10.

The device 10 includes a housing 12 having vertically extending flanges 14 and 16 on opposite ends thereof. The flanges 14 and 16 are adapted to contact a mating surface on the bowl 22 of a feeder. A gib 18 is bolted to the feeder bowl slide assembly 23 and overlies flange 14. Similarly, a gib 20 overlies flange 16. Flanges 14 and 16 enable the device to be bolted to a feeder bowl slide assembly in the same manner as a prior art device whereby the present invention may be substituted for such prior art device.

The housing 12 includes a rear wall 24, front wall 26, side walls 28 and 30, and a bottom wall 32. The height of side walls 28 and 30 is less than the height of rear wall 24 as shown more clearly in FIG. 2. Side flanges 28' and 30' are extensions of the walls 28, 30 respectively.

A pair of vertically disposed shafts 34 and 34' are supported by the housing 12 and extend below the bottom wall 32. Each of the shafts 34, 34' is identical except as will be made clear hereinafter. Hence, only shaft 34 will be described in detail with corresponding primed numerals being provided on the structure associated with shaft 34'.

A nut 36 is threaded to the shaft 34 and overlies a washer 38. Beneath the washer 38 there is provided a sleeve 40 extending to a bearing retainer 42. Within the horizontally disposed intermediate wall 45 on the housing 12, there is provided a bearing 43 beneath the retainer 42. A splined shaft 44 is keyed to or is integral in one piece with the shaft 34. A hub 46 is keyed to the shaft 44. A worm wheel 48 projects radially outwardly from the hub 46.

Figure 3:
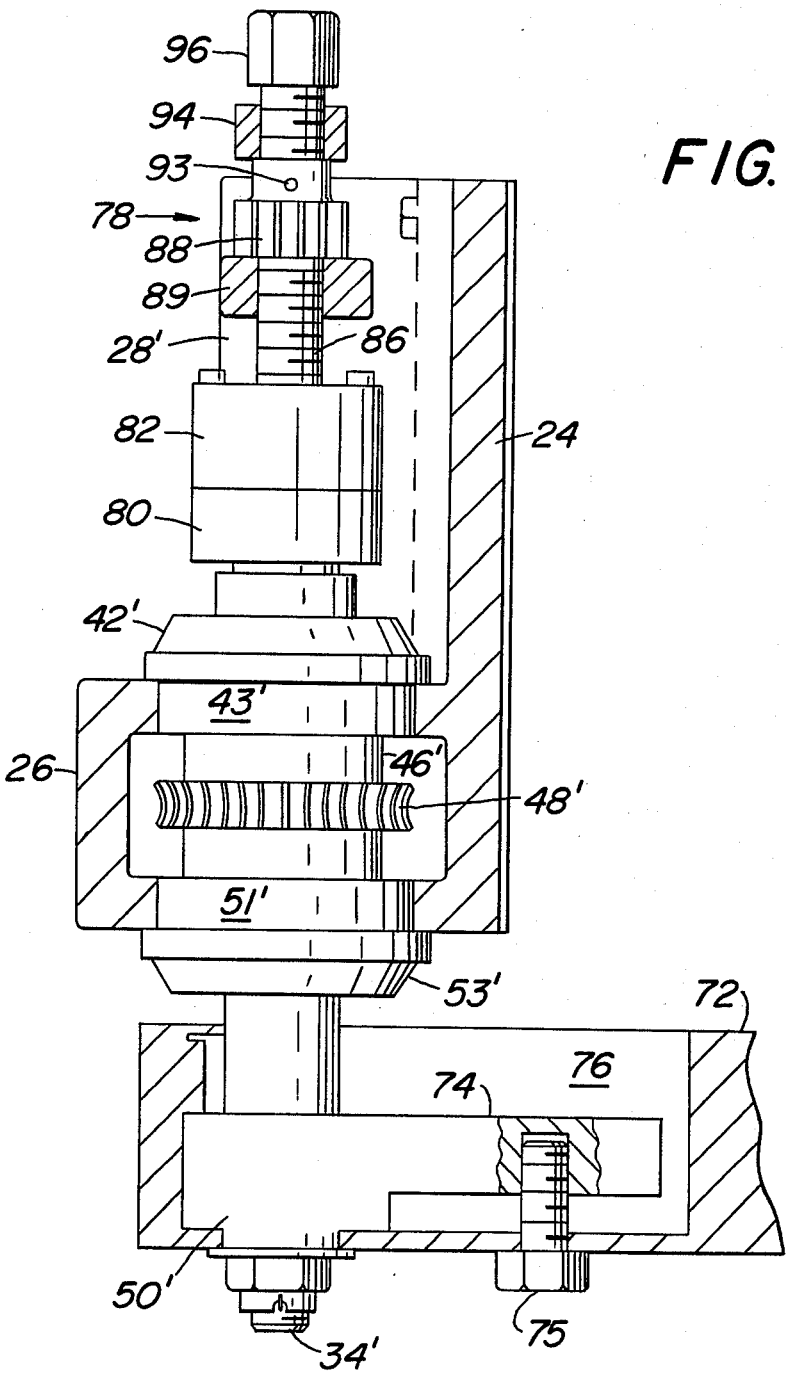
FIG. 3 is a sectional view taken along the line 3—3 in FIG. 1.

A bearing 51 is provided in the bottom wall 32 and is held there by retainer 53. Below the retainer 53, the shaft 34 is attached to a hub 50 and retained in assembled relationship with a arm 54 by the nut 52. The arm 54, as shown more clearly in FIG. 1, has a slot 58 into which extends a tongue 56 from the hub 50. Set screws 60 are threaded to the arm 54 and engage opposite side faces of tongue 56. A bolt not shown, but similar to bolt 75 in FIG. 3, secures tongue 56 to arm 54. The set screws 60 and the tongue 56 may be adjusted through a limited range to adjust the angular relationship of arm 54 with respect to shaft 34. One or more blades 55 is attached to the arm 54 in a conventional manner.

A motor mounting bracket 64 is bolted to the front wall 26 of the housing 12. Bracket 64 supports a reversible electric motor 66. Motor 66 may be a dc servo motor capable of being rotated in opposite directions and preferably has a position feedback and a velocity feedback from a controller such as a computer. The output shaft of motor 66 is connected to a worm 68 by a coupling 67. Worm 68 is meshed with the gear wheels 48, 48' and is thereby mechanically coupled to shafts 34, 34'. See FIGS. 1 and 2.

The shaft 34' is coupled to arm 72 in a similar manner to that described above. The hub 50' has a tongue 74 which is adjustably coupled within a slot in the arm 72 as described above. Bolt 75 extends through a slot in arm 72 and is threaded to tongue 74. Arm 72 is provided with one or more blades 73. Blades 73 are below the elevation of blades 55. The blades 55 and 73 overlap in a closed position when cutting a stream of molten glass into gobs.

Figure 2:
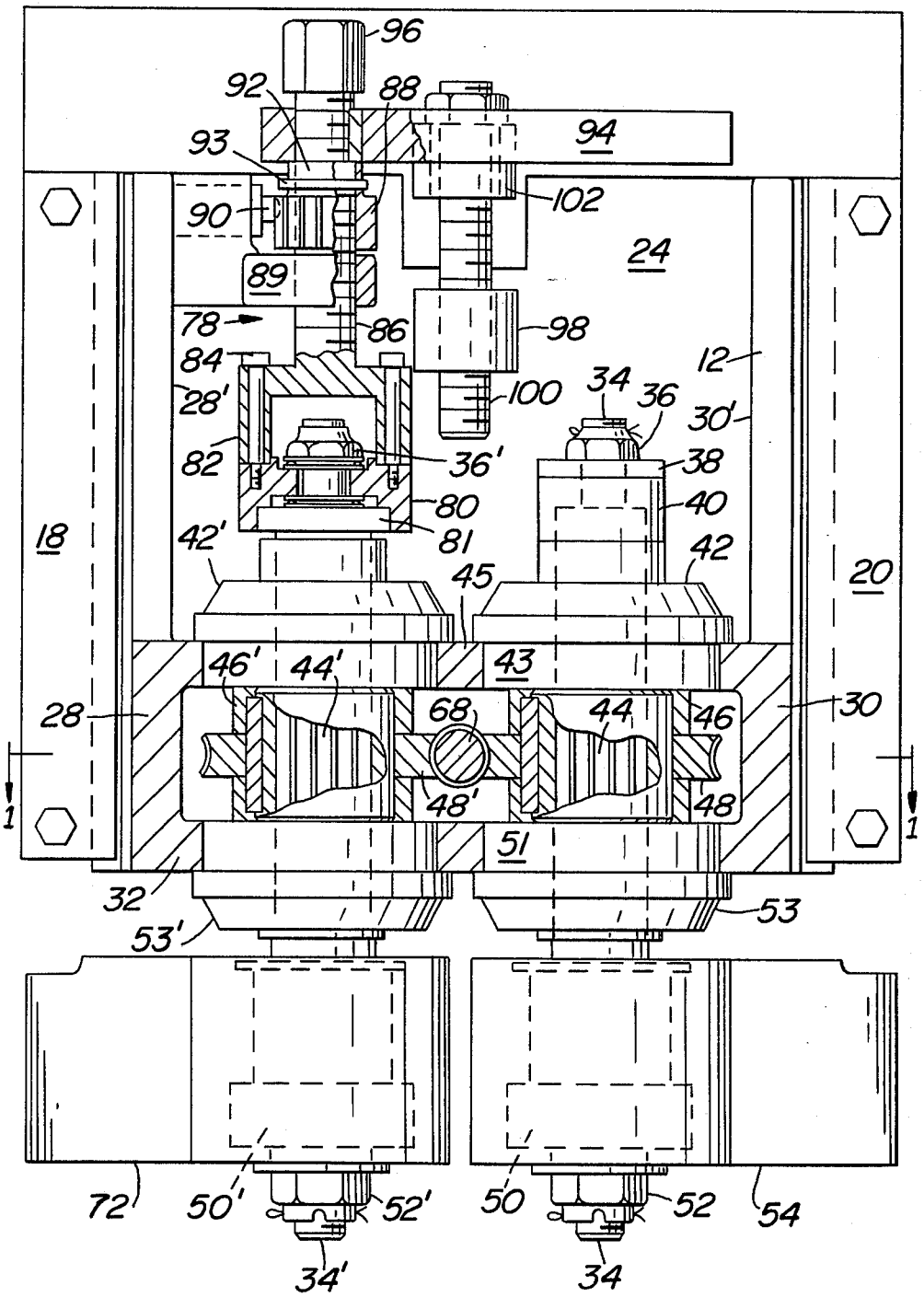
FIG. 2 is a sectional view taken along the line 2—2 in FIG. 1.

A tension device 78 is provided for tensioning the blade overlap. It is preferred that the device 78 be coupled to arm 72 which supports the lower blades 73. Referring to FIG. 2, the device 78 includes a collar 80 which surrounds the upper end of shaft 34'. Collar 80 has a radially inwardly directed annular flange which overlies thrust bearings on washer 81. Washer 81 rests on the upper end of shaft 44'. Nut 36' overlies thrust bearings on the upper surface of the annular flange of collar 80. A cup shaped housing 82 is bolted to the collar 80 by a plurality of bolts 84.

Housing 82 has an upstanding integral threaded shaft 86. Shaft 86 is threaded to mating threads on the inner periphery of boss 89. Boss 89 is fixed to the side flange 28'. A gear 88 is fixed to shaft 86 by pin 93 so that shaft 86 and gear 88 rotate as a unit. Detent 90 engages gear 88 to inhibit unintentional rotation of gear 88 and shaft 86. Gear 88 has an upstanding annular key 92 coupled to a ratchet on arm 94. A bolt 96 is threaded to the upper end of shaft 86.

The entire mechanism 10 may be adjusted vertically relative to the feeder bowl 22. Thus, rear wall 24 has a boss 98 fixed thereto. A jack screw 100 is threaded to the inner surface of boss 98. The upper end of jack screw 100 passes through bracket 102 on the shear slide assembly 23 on the feeder bowl 22. Rotation of jack screw 100 will change the relative elevation of the entire mechanism 10 relative to the feeder bowl 22.

To adjust the tension of overlap of blades 55 and 73, ratchet arm 94 is rotated. Arm 94 rotates the gear 88 from one detent position to another thereby rotating shaft 86. Rotation of shaft 86 relative to boss 89 causes shaft 86 to move vertically. As a result, splined shaft 34' moves vertically along its vertically disposed longitudinal axis relative to the hub for worm wheel 48'.

Since the mechanism 10 includes its own drive motor 66, the entire mechanism may be selectively positioned around the periphery of the feeder bowl 22 for changing the angle of the shears 90° left or 90° right to allow for any possible orientation of a forming maching below the elevation of the feeder. As a result thereof, there is a larger range of adjustment of the position of the shear mechanism with respect to the feeder bowl as compared with the prior art wherein the range of adjustment was limited by the levers, cams etc.

There is a greater range of operating speeds because the mechanism 10 of the present invention facilitates adjustment of the speed of the blades 55, 73 on the fly. The present invention makes possible adjustment of the phase relationship of the shear blades 55, 73 with respect to the feeder mechanism which controls the discharge rate of the glass stream. Thus, timing of the shear blades 55, 73 can be based on a sensing of the position of the feeder mechanism cam to be certain that the feeder mechanism and the shear mechanism are synchronized.

Prior art devices had a means for adjusting the angular opening of the arms 54, 72. That was accomplished by putting in a new cam and new links after stopping the operation. The present invention facilitates adjustment of the angular opening of the arms 54, 72 on the fly by operating the motor 66 for a longer period of time. The extent of angular opening of arms 54, 72 is a function of the displacement (total angular rotation) of motor 66 and is not necessarily a function of time. Also, it is possible to adjust the amount of blade overlap on the fly.

The present invention facilitates operating the blade arms 54, 72 at different speeds during their operation. That is, the arms 54, 72 can be caused to open at one speed and close at another speed by appropriately controlling the drive circuity of motor 66. This feature can allow for a shorter time cycle which means greater productivity, or alternatively it is possible to attain the same cycle time but provide for greater dwell time for blades. Greater dwell time facilitates improved cooling of the blades. If the blades are too hot, the molten glass sticks to it. Regardless of cycle time, the cutting speed must always be uniform with deceleration as the blades cut through the glass stream. The present invention facilitates tailoring the action of the shear blades 55, 73 to the job to be done.

For purposes of maintenance in changing of blades 55, 73, the motor 66 can be operated to move the arms 54, 72 to a position wherein the included angle is more than 120°. This will result in the blades 55, 73 being positioned out in the open for ease of operator access instead of being beneath the feeder bowl where access is difficult.

As the operative portion of the worm 68 and worm wheels 48, 48' wears, it is possible to disconnect the arms 54, 72. Thereafter, the worm wheels can be rotated to a different segment of their periphery. Thereafter, when the components are reassembled there will be a lack of backlash. While a worm and worm wheels are preferred, other types of gears may be used.

Prior art devices may operate at a maximum speed of 135 shear cuts per minute. The present invention can increase the maximum speed to 220 shear cuts per minute. This is significant when it is considered that the mechanism 10 may be substituted for a conventional mechanism on the feeder bowl using the identical mounting means on the feeder bowl.

The present invention may be embodied in other specific forms without departing from the spirit or essential attributes thereof and, accordingly, reference should be made to the appended claims, rather than to the foregoing specification, as indicating the scope of the invention.

I claim:

1. A shear mechanism adapted to be attached to a feeder bowl for cutting a glass stream into gobs comprising a housing adapted to be attached to a feeder bowl, first and second shafts in said housing, a discrete arm connected to each shaft, at least one discrete blade connected to each arm, said blades being in overlapping relation in one position of said arms, a reversible electric motor supported by said housing, said motor having its output mechanically coupled by gears to said shafts for oscillating said shafts and arms in unison in opposite directions between open and closed positions by changing the direction of rotation of said motor.

2. A mechanism in accordance with claim 1 including means for adjusting one shaft vertically along its longitudinal axis relative to the other shaft for adjusting the tension of blade overlap.

3. A mechanism in accordance with claim 1 wherein said shafts are mechanically coupled to said motor output by a worm meshed with a pair of worm wheels, each worm wheel being mechanically coupled to one of said shafts, said worm being mechanically coupled to the output of said motor.

4. A mechanism in accordance with claim 1 wherein said motor is a dc servo motor adapted for adjusting the angular opening of the arms and the speed of the arms on the fly.

5. A shear mechanism adapted to be attached to a feeder bowl for cutting a glass stream into gobs comprising a housing adapted to be attached to a feeder bowl, first and second vertical shafts in said housing, a discrete arm connected to the lower end of each shaft, at least one discrete blade connected to each arm, said blades being in overlapping relation in one position of said arms, a reversible electric motor supported by said housing, said motor having its output mechanically coupled to a discrete gear on each of said shafts for oscillating said shafts and arms in unison in unison in opposite directions between open and closed positions, and means for adjusting one shaft vertically along its longitudinal axis relative to the other shaft for adjusting the tension of blade overlap without interfering with the coupling between said motor and said gears.

6. A method of cutting a glass stream into gobs by a shear mechanism attached to a feeder bowl, and wherein said shear mechanism includes a pair of pivotable arms each having a blade comprising the steps of supporting a reversible electric motor on said mechanism, oscillating said arms in unison in opposite directions between open and closed positions by changing the direction of rotation of said motor, using said motor to adjust on the fly one or more of the blade timing, extent of angular opening of the blades, and speed of the blades as they move between open and closed positions.

7. A method in accordance with claim 6 wherein said oscillating step includes controlling the speed of the motor and controlling the time duration of rotation of said motor.

8. A shear mechanism adapted to be attached to a feeder bowl for cutting a glass stream into gobs comprising a housing having structure adapted to be secured to a feeder bowl, first and second gears in said housing, a discrete arm connected to each gear, at least one blade connected to each arm, said blades being in an overlapping relation in one position of said arms, a reversible electric motor supported by said housing, said motor having its output mechanically connected to said first and second gears by a third gear for oscillating said arms in opposite directions between open and closed positions, said third gear being in meshing engagement with said first and second gears, said third gear being connected to said motor.

9. A shear mechanism in accordance with claim 8 wherein the longitudinal axis of said third gear is perpendicular to the longitudinal axes of said first and second gears.

10. A mechanism in accordance with claim 8 wherein said motor is supported in a manner so as to have its output shaft horizontally disposed and directed to the space between the axes of said first and second gears.

* * * * *